US009568239B2

(12) United States Patent
Kim et al.

(10) Patent No.: US 9,568,239 B2
(45) Date of Patent: Feb. 14, 2017

(54) REFRIGERATOR

(71) Applicant: LG ELECTRONICS INC., Seoul (KR)

(72) Inventors: Hyunbum Kim, Seoul (KR); Jihyun Im, Seoul (KR); Jindong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/528,137

(22) Filed: Oct. 30, 2014

(65) Prior Publication Data

US 2015/0123534 A1 May 7, 2015

(30) Foreign Application Priority Data

Nov. 1, 2013 (KR) ..... 10-2013-0132222

(51) Int. Cl.

| | |
|---|---|
| ***F25D 23/02*** | (2006.01) |
| ***F25D 23/04*** | (2006.01) |
| ***F25D 25/02*** | (2006.01) |
| *E05D 3/16* | (2006.01) |

(52) U.S. Cl.

CPC ..... *F25D 23/028* (2013.01); *F25D 23/02* (2013.01); *F25D 23/04* (2013.01); *F25D 25/02* (2013.01); *E05D 3/16* (2013.01); *E05Y 2900/31* (2013.01)

(58) Field of Classification Search

CPC ..... F25D 23/02; F25D 23/04; F25D 23/025; F25D 23/028; F25D 25/02

USPC ..... 312/401, 405, 405.1, 291, 326, 329; 16/282, 287, 294; 292/DIG. 71

See application file for complete search history.

(56) References Cited

U.S. PATENT DOCUMENTS

| | | | | |
|---|---|---|---|---|
| 1,927,398 | A | 9/1933 | Glasser | |
| 2,021,702 | A | 11/1935 | Soss | |
| 2,070,511 | A | 2/1937 | Clements | |
| 2,124,857 | A | 7/1938 | MacGrath | |
| 2,129,923 | A * | 9/1938 | Frankel | F25D 11/02 126/197 |
| 2,131,522 | A * | 9/1938 | Peterson | F25D 23/04 126/197 |
| 2,213,274 | A * | 9/1940 | Flamm | F25D 11/02 312/199 |
| 2,674,761 | A | 4/1954 | Weiss | |
| 5,471,709 | A * | 12/1995 | Lanzani | A47L 15/4261 16/238 |
| 5,497,534 | A * | 3/1996 | Caruso | E05D 3/06 16/288 |
| 2010/0308705 | A1* | 12/2010 | Kwon | F25D 23/025 312/404 |

(Continued)

FOREIGN PATENT DOCUMENTS

| | | |
|---|---|---|
| EP | 2 565 565 A2 | 3/2013 |
| JP | S 50-084862 U | 7/1975 |

OTHER PUBLICATIONS

European Search Report dated Apr. 16, 2015 for Application No. 14191293.1, 7 Pages.

*Primary Examiner* — James O Hansen

(74) *Attorney, Agent, or Firm* — Fish & Richardson P.C.

(57) ABSTRACT

Disclosed is a refrigerator including a cabinet defining a first storage area to store food, a door connected to the cabinet by first hinge members, so as to be rotatable about a first rotary shaft located at the front portion of the cabinet, and opening and closing the first storage area, a gasket provided on the door, and a container defining a second storage area received in the first storage area and being rotatable by a second hinge member installed on the cabinet.

16 Claims, 10 Drawing Sheets

(56) References Cited

U.S. PATENT DOCUMENTS

| | | | | |
|---|---|---|---|---|
| 2012/0062093 | A1* | 3/2012 | Lee | F25D 23/025 312/405 |
| 2013/0016492 | A1 | 1/2013 | Wang | |
| 2013/0049562 | A1* | 2/2013 | Jung | F25D 23/028 312/405 |
| 2013/0278127 | A1 | 10/2013 | Kim | |

* cited by examiner

REFRIGERATOR

This application claims the benefit of Korean Patent Application No. 10-2013-0132222, filed on Nov. 1, 2013, which is hereby incorporated by reference as if fully set forth herein.

BACKGROUND OF THE INVENTION

Field of the Invention

The present invention relates to a refrigerator, and more particularly, to a refrigerator having a separate storage chamber in addition to main storage chambers to improve user convenience.

Discussion of the Related Art

In general, a refrigerator is an apparatus that stores food in a frozen state or in a refrigerated state by maintaining a storage chamber at a designated temperature using a refrigerating cycle consisting of a compressor, a condenser, an expansion valve, and an evaporator. The refrigerator generally includes a freezing chamber storing food and drinks in a frozen state and a refrigerating chamber storing food and drinks at a low temperature.

Refrigerators are divided according to positions of freezing and refrigerating chambers. For example, refrigerators may be divided into a top mount type in which a freezing chamber is disposed above a refrigerating chamber, a bottom freezer type in which a freezing chamber is disposed below a refrigerating chamber, and a side by side type in which a freezing chamber and a refrigerating chamber are divided side by side by a diaphragm.

A freezing chamber and a refrigerating chamber of a refrigerator are provided within a cabinet forming the external appearance of the refrigerator and are selectively opened and closed by a freezing chamber door and a refrigerating chamber door. The freezing chamber door and the refrigerating chamber door are rotatably attached to the freezing and refrigerating chambers having opened front surfaces, and gaskets for sealing of the insides of the storage chambers are provided on the respective doors.

Recently, a refrigerator, which copes with various consumer requirements and prevents cool air loss caused by frequent opening and closing of doors, has been proposed. For example, a refrigerator, in which a separate storage space (hereinafter, referred to as a 'subsidiary storage chamber' for convenience) in addition to main storage chambers is provided and a user may access the subsidiary storage chamber without opening of doors of the refrigerator, has been proposed.

SUMMARY OF THE INVENTION

Accordingly, the present invention is directed to a refrigerator that substantially obviates one or more problems due to limitations and disadvantages of the related art.

An object of the present invention is to provide a refrigerator having a simple structure which may improve user convenience and suppress increase in power consumption.

Another object of the present invention is to provide a refrigerator which may have a sufficient thickness of doors so as to use a subsidiary storage chamber.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a cabinet defining a first storage area to store food, a door connected to the cabinet by first hinge members, so as to be rotatable about a first rotary shaft located at the front portion of the cabinet, and opening and closing the first storage area, a gasket provided on the door, and a container defining a second storage area received in the first storage area and being rotatable by a second hinge member installed on the cabinet, wherein the second hinge member includes a first link and a second link installed on the container so as to be rotatable and a third link and a fourth link installed on the cabinet so as to be rotatable, wherein each of the first link and the second link is connected to at least one of the third link and the fourth link by a rotary shaft so as to be rotatable.

A first mount part with which the first link and the second link are combined so as to be rotatable may be installed on the container and a second mount part with which the third link and the fourth link are combined so as to be rotatable may be installed on the cabinet.

The first mount part may be installed on one side surface of the container.

Further, the first mount part may be installed at at least one of the upper and lower portions of one side surface of the container.

Of course, the second mount part may be installed in a depression part formed on the cabinet.

A reception part communicating with the depression part may be formed on the cabinet and, when the container closes the first storage area, parts of the first link and the second link may be received in the reception part.

The first link may be disposed at the uppermost position and the third link, the second link, and the fourth link may be sequentially disposed under the first link.

When the container closes the first storage area, parts of the first link, the second link, the third link, and the fourth link may be disposed so as to overlap each other.

Each of the first link, the second link, and the third link may include a vertical surface provided vertically and two extension surfaces bent from both sides of the vertical surface and extended.

Of course, each of the rotary shafts passes through the two extension surfaces.

Further, the vertical surface of the first link, the vertical surface of the second link, and the vertical surface of the third link may be coplanar.

The second link may include a first escape groove which the rotary shaft installed on the first link does not contact and the third link may include a second escape groove which the rotary shaft installed on the fourth link does not contact.

The fourth link may include a vertical surface provided vertically and the length of the vertical surface of the fourth link may be smaller than that of the vertical surface of the third link.

The lengths of the vertical surfaces of the first link and the second link may be smaller than that of the vertical surface of the third link.

When the container is rotated, the rotary shafts may be moved together with rotation of the container.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
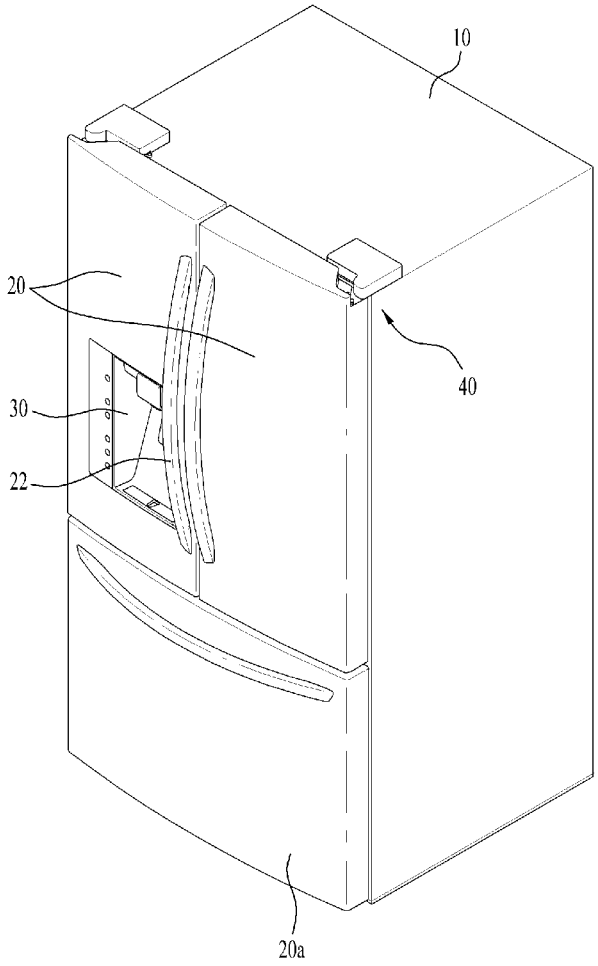
FIG. 1 is a perspective view illustrating a refrigerator in accordance with one embodiment of the present invention.

Reference will now be made in detail to the preferred embodiments of the present invention, examples of which are illustrated in the accompanying drawings.

Herein, sizes or shapes of elements shown in the drawings may be exaggerated for clarity and convenience of description. Further, terms specifically defined in consideration of the configuration and functions of the present invention may be varied according to the intention of a user or an operator or usual practice. The definitions of these terms should be determined based on the whole content of this specification.

In FIG. 1, storage chambers which may store food, for example, a refrigerating chamber and a freezing chamber below the refrigerating chamber, are provided within a cabinet 10. In order to open and close the refrigerating chamber, doors 2 are rotatably installed at the upper portion of the cabinet 10 by hinge members 40 (hereinafter, referred to as 'first hinge members' for convenience). Although this embodiment describes two doors 20 opening and closing the refrigerating chamber, embodiments of the present invention are not limited thereto and one door may be used. Handles 22 allowing a user to rotate the doors 20 may be installed on the doors 20. Of course, the shape or structure of the doors 22 is not limited thereto and may be variously designed.

A dispenser 30 to dispense water or ice to a user may be provided at one side of the door 20. Another door 20*a* opening and closing the freezing chamber may be installed at the lower portion of the cabinet 10.

Figure 2:
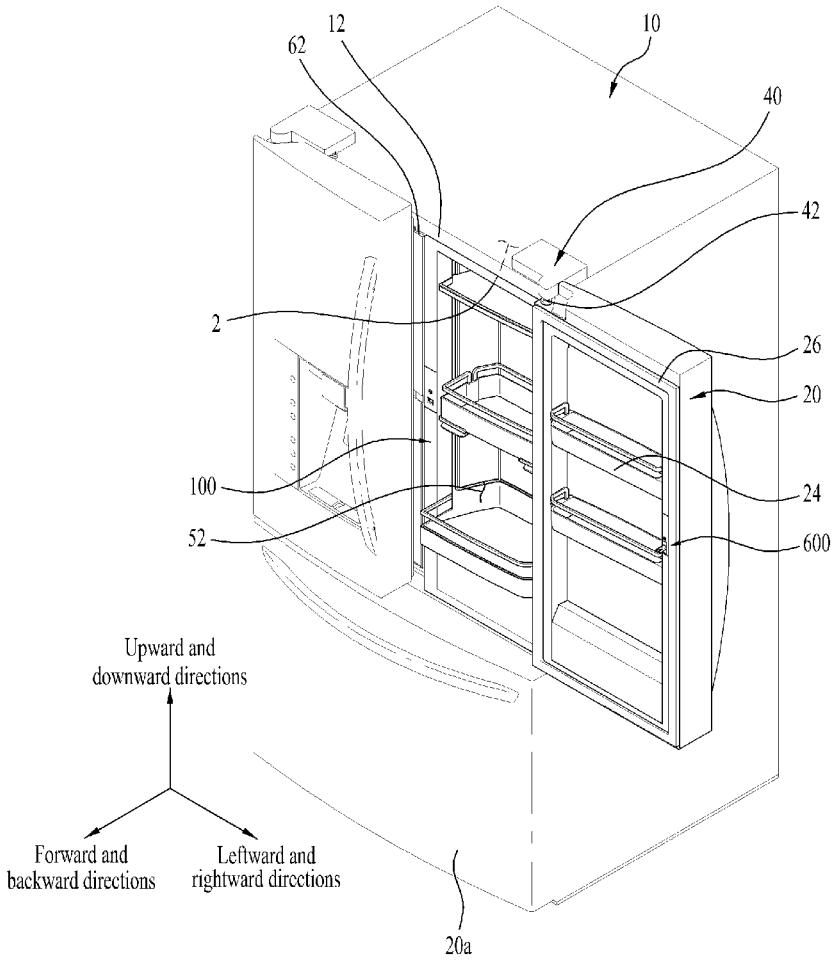
FIG. 2 is a perspective view illustrating the refrigerator of FIG. 1 in a state in which a door alone is opened.

As exemplarily shown in FIG. 2, a storage space to store food, i.e., a refrigerating chamber 2, is provided within the cabinet 10. Although this embodiment mainly describes the refrigerating chamber 2 for convenience of description, embodiments of the present invention are not limited to the refrigerating chamber 2 and may be applied to any storage space to store food, such as a freezing chamber, and thus, the refrigerating chamber 2 is referred to as a 'first storage area' for convenience.

Further, in this embodiment, a container 100 defining another storage chamber 52 (hereinafter, referred to as a 'second storage area' for convenience) differing from the first storage area 2 is provided. The container 100 is provided so as to be rotatable with respect to the door 20 and is independent of the cabinet 10 and the door 20.

Hereinafter, relations among the cabinet 10, the door 20, and the container 100, and structures thereof will be described in detail with reference to FIG. 2. FIG. 2 illustrates the refrigerator in a state in which the container 100 is received within the cabinet 10 and the door 20 alone is opened.

The door 20 is rotatably combined with the cabinet 10 by the first hinge members 40. The first hinge member 40 is located at one side of the cabinet 10. The door 20 is rotated about a rotary shaft 42 of the first hinge member 40 (hereinafter, referred to as a 'first rotary shaft' for convenience) and may open and close the first storage area 2.

A gasket 26 is provided at the inner surface of the door 20. The gasket 26 is provided along the edge of the door 20. The gasket 26 may be formed in a rectangular shape corresponding to the rectangular shape of the door 20. When the door 20 is rotated toward the cabinet 10 and closes the first storage area 2, the gasket 26 contacts a front surface 12 of the cabinet 10 and functions to prevent leakage of cool air from the first storage area 2.

Hereinafter, for convenience of description, the terms upward and downward directions, leftward and rightward directions, and forward and backward directions will be used, as exemplarily shown in FIG. 2. The size of the container 100 (the length in the leftward and rightward directions (the width) and the length in the upward and downward directions (the height)) may not exceed the first storage area 2 so that the container 100 may be received in the first storage area 2. The depth of the container 100 (the length in the forward and backward directions) may occupy a designated portion of the depth of the first storage area 2. Through such a configuration, if the door 20 is closed, the container 100 is located in the first storage area 2, there is a possibility of cool air leakage through only a gap between the front surface 12 of the cabinet 10 and the edge of the inner surface of the door 20. Therefore, cool air leakage may be prevented only by installing one gasket 16 at the edge of the inner surface of the door 20. Thus, in accordance with this embodiment, only the gasket 26 for the door 20 may be provided without a gasket for the container 100. That is, in accordance with this embodiment, cool air loss due to installation of a plurality of gaskets or waste of energy for heating may be effectively prevented.

Further, a latch 600 to selectively combine the container 100 with the door 20 may be installed on the door 20. That is, the latch 600 serves to combine the container 100 with the door 20 when both the door 20 and the container 100 are opened and serves to release combination between the container 100 and the door 20 when the door 20 alone is opened. In order to combine the container 100 with the door 20 and release combination between the container 100 and the door 20 by the latch 600, an operation unit may be provided on the handle 22.

Further, storage parts 24 to store food may be provided on the inner surface of the door 20. That is, after a user opens the door 20, as exemplarily shown in FIG. 2, the user may access the storage part 24 and store food in the storage part 24 installed on the inner surface of the door 20 or take food out of the storage part 24. Of course, instead of installation of the storage parts 20 on the door 20, the depth of the container 100 may be increased so that the container 100 may use the space occupied by the storage parts 20 of the door 20.

Figure 3:
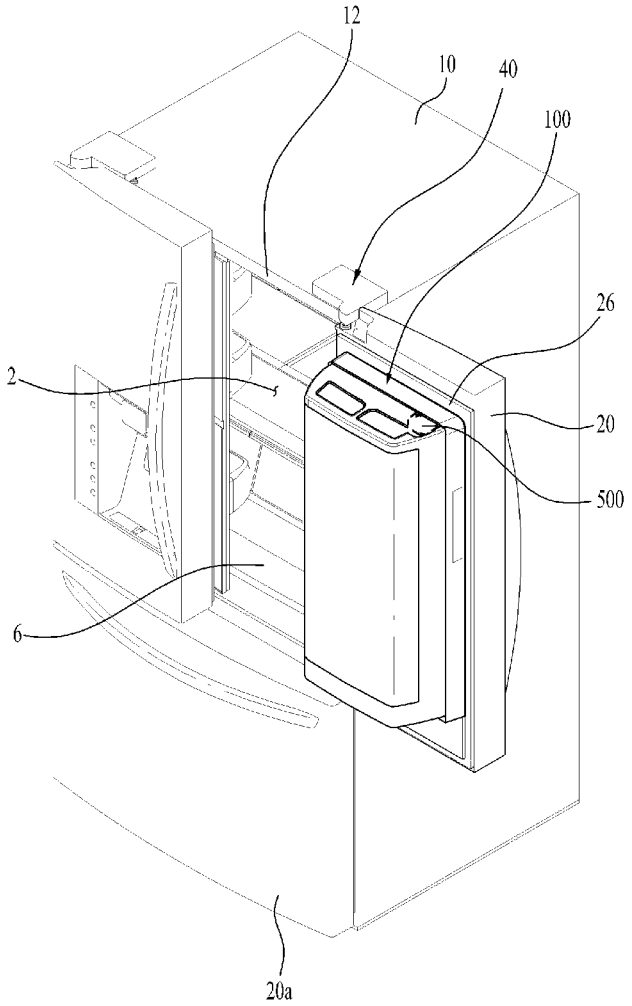
FIG. 3 is a perspective view illustrating the refrigerator of FIG. 1 in a state in which both the door and a container are opened.

Next, opening of both the door 20 and the container 100 will be described with reference to FIG. 3.

If a user desires to use the first storage area 2, when the user opens both the door 20 and the container 100 together, the first storage area 2 enters a user accessible state. The first storage area 2 may have substantially the same structure as a storage chamber of a general refrigerator. For example, a plurality of shelves 4, a plurality of drawers 6, etc. may be provided within the first storage area 2.

A fixing device 500 to selectively combine the container 100 with the cabinet 10 may be provided on the container 100. That is, the fixing device 500 serves to combine the container 100 with the cabinet 10 when the door 20 alone is opened and serves to release combination between the container 100 and the cabinet 10 when both the door 20 and the container 100 are opened together.

A filler 62 is installed at the left door 20 of the two doors 20. The filler 62 may be disposed between the two doors 20 when the two doors 20 close the first storage area 2 and thus prevent cool air leakage through a gap between the two doors 20. The filler 62 is well known in the art and a detailed description thereof will thus be omitted.

Figure 4:
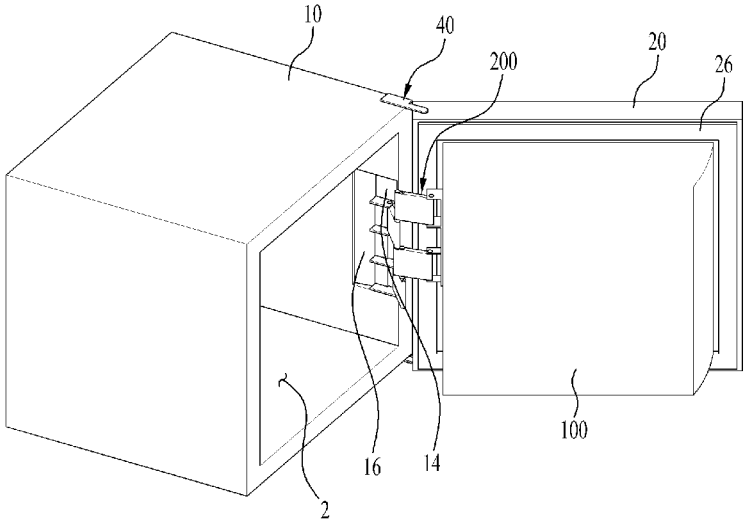
FIG. 4 is a view illustrating a state in which a second hinge member in accordance with one embodiment of the present invention is installed.

FIG. 4 is a view illustrating a state in which a second hinge member in accordance with one embodiment of the present invention is installed. Hereinafter, the second hinge member will be described with reference to FIG. 4.

The container 100 is rotatably combined with the cabinet 10 by a second hinge member 200. That is, the second hinge member 200 is disposed within the first storage area 2.

The door 20 is rotatably installed on the cabinet 10 by the first hinge members 40, and the container 100 is rotatably installed on the cabinet 10 by the second hinge member 200. Therefore, the door 20 and the container 100 are rotatably disposed on the cabinet 10 independently of each other.

A depression part 14 having a designated depth and a reception part 16 communicating with the depression part 14 are formed on the inner surface of the cabinet 10.

The depression part 14 is a space to install the first hinge member 200 in the cabinet 10 and the reception part 16 is a space in which the second hinge member 200 is movable without contact with the cabinet 10.

A region of the cabinet 10 having the depression part 14 and the reception part 16 has a smaller thickness than other regions of the cabinet 10. However, this region is not connected to the opening through which cool air may leak and thus, it is judged from as a result of experiments that reduction in a degree of insulation generated due to the decreased thickness is not great.

Figure 5:
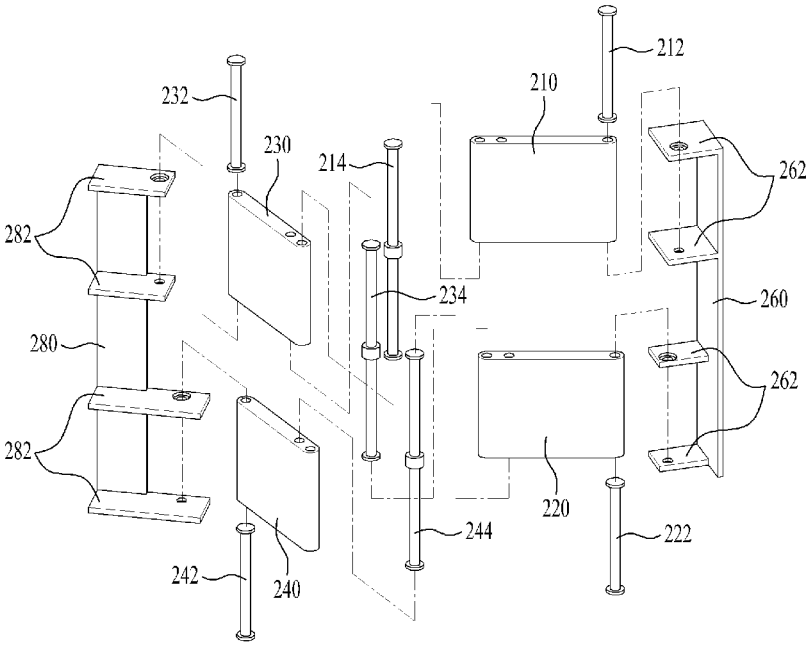
FIG. 5 is an exploded perspective view of the second hinge member of FIG. 4.
Figure 6:
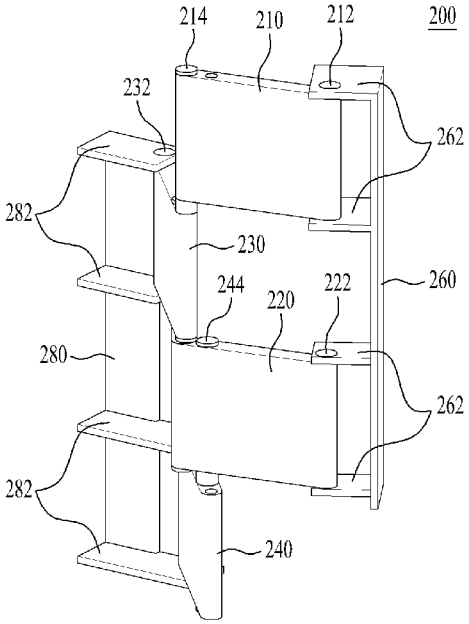
FIG. 6 is a view illustrating the assembled second hinge member of FIG. 5.

FIG. 5 is an exploded perspective view of the second hinge member of FIG. 4 and FIG. 6 is a view illustrating the assembled second hinge member of FIG. 5. Hereinafter, the second hinge member will be described in more detail with reference to FIGS. 5 and 6.

The second hinge member 200 in accordance with one embodiment includes a first link 210 and a second link 220 rotatably installed on the container 100 and a third link 230 and a fourth link 240 rotatably installed on the cabinet 10.

The second hinge member 200 may include a first mount part 260 with which the first link 210 and the second link 220 are rotatably combined and the first mount part 260 may be installed on the container 100.

Further, the second hinge member 200 may include a second mount part 280 with which the third link 230 and the fourth link 240 are rotatably combined and the second mount part 280 may be installed on the cabinet 10. Particularly, the second mount part 280 may be installed in the depression part 14.

The first link 120 is combined with the first mount part 260 so as to be rotatable about a rotary shaft 212. Here, the rotary shaft 212 may include flange parts having an increased radius at both ends thereof so that the rotary shaft 212 is not removed from the first link 210 in the upward and downward directions. All rotary shafts which will be described hereinafter include flange parts so that the rotary shafts are not removed from elements combined therewith in the upward and downward directions.

The third link 230 may be disposed below the first link 210 and be combined with the first link 210 so as to be rotatable about a rotary shaft 214. Here, the length of the rotary shaft 214 may be greater than the length of the rotary shaft 212 so as to connect the first link 210 and the third link 230.

The rotary shaft 214 may include a separate interval maintenance member so as to maintain a vertical interval between the first link 210 and the third link 230. The first link 210 and the third link 230 are separated by the vertical interval by the interval maintenance member and thus, interference between operations of the first link 210 and the third link 230 may be prevented. Although there is no additional description, all rotary shafts connecting respective links may include interval maintenance members.

The third link 230 is combined with the second mount part 280 so as to be rotatable about a rotary shaft 232.

The second link 220 may be disposed below the third link 230 and be combined with the third link 230 so as to be rotatable about a rotary shaft 234. Here, the rotary shaft 234 may include a separate interval maintenance member so as to maintain a vertical interval between the third link 230 and the second link 220.

The second link 220 is combined with the first mount part 260 so as to be rotatable about a rotary shaft 222.

The fourth link 240 may be disposed below the second link 220 and be combined with the second link 220 so as to be rotatable about a rotary shaft 244.

Movement of one end of the fourth link 240 is restricted by the rotary shaft 244 connected to the second link 220 and movement of the other end of the fourth link 240 is restricted by a rotary shaft 242 connected to the second mount part 280.

That is, one end of the first link 210 is connected to the first mount part 260 by the rotary shaft 212 and the other end of the first link 210 is connected to the third link 230 by the rotary shaft 214.

The third link 230 is connected to the first link 210 by the rotary shaft 214, connected to the second link 220 by the rotary shaft 234, and connected to the second mount part 280 by the rotary shaft 232.

That is, the respective links are connected to other members by two rotary shafts or three rotary shafts and may thus guide rotation of the container 100.

The first mount part 260 includes a plurality of diaphragms 262 dividing a vertical space and may form a structure in which the first link 210 and the second link 220 may be fixed to designated vertical positions and load may be stably supported. Further, the diaphragms 262 may be extended to the uppermost ends and the lowermost ends of the respective links so that both ends of the rotary shafts may be supported.

In the same manner, the second mount part 280 includes a plurality of diaphragms 282 dividing a vertical space and may form a structure in which the third link 230 and the fourth link 240 may be fixed to designated vertical positions and load may be stably supported. Further, the diaphragms 282 may be extended to the uppermost ends and the lowermost ends of the respective links so that both ends of the rotary shafts may be supported.

Figure 7:
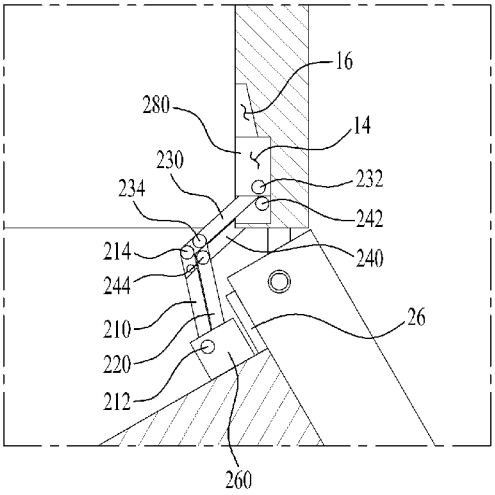
FIG. 7 is a view illustrating the second hinge member in an unfolded state.
Figure 8:
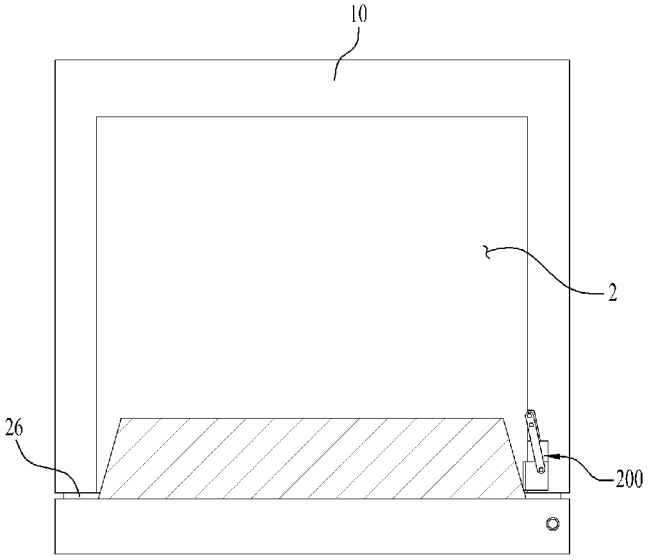
FIG. 8 is a view illustrating the second hinge member in a folded state.

FIG. 7 is a view illustrating the second hinge member in an unfolded state and FIG. 8 is a view illustrating the second hinge member in a folded state. Hereinafter, the second hinge member will be described in more detail with reference to FIGS. 7 and 8.

Since the container 100 is combined with the cabinet 10 by the second hinge member 200 so as to be rotatable, movement of the door 20 does not influence the container 100.

When the second hinge member 200 is unfolded, as exemplarily shown in FIG. 7, the container 100 is rotated away from the cabinet 10 and the first storage area 2 is opened.

On the other hand, when the second hinge member 200 is folded, as exemplarily shown in FIG. 8, the container 100 is disposed at a position of closing the first storage area 2.

In the folded state of the second hinge member 200, as exemplarily shown in FIG. 8, the first link 210, the second link 220, the third link 230, and the fourth link 240 overlap, as seen from the top. Therefore, a space of the first storage area 2 occupied by the first link 210, the second link 220, the third link 230, and the fourth link 240 is reduced and thus, the first storage area 2 may be effectively used.

The first mount part 260 is installed at one side surface of the container 100 and may prevent the first hinge member 200 from damaging the gasket 26 due to contact with the gasket 26 during movement of the container 100.

Particularly, when the container 100 closes the first storage area 2, as exemplarily shown in FIG. 8, parts of the first link 210 and the second link 220 may be received in the reception part 16. Therefore, the first link 210 and the second link 220 may be partially received in the reception part 16 of the cabinet 10 rather than the first storage area 2 and thus, reduction in the size of the first storage area 2 may be prevented.

In the present invention, when the container 100 is rotated with respect to the cabinet 10 by the second hinge member 200, the rotary shafts connecting the respective links are moved together with the container 100. That is, since movement trajectory of the second hinge member 200 is changed according to movement of the container 100, interference between the second hinge member 200 and the gasket 26 may be prevented.

Figure 9:
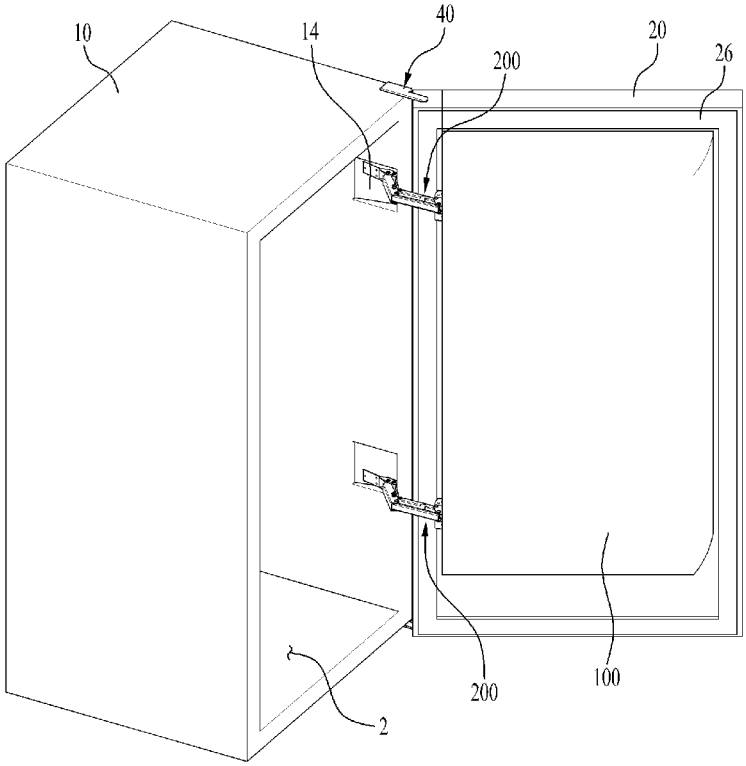
FIG. 9 is a view illustrating a state in which second hinge members in accordance with another embodiment of the present invention are installed.

FIG. 9 is a view illustrating a state in which second hinge members in accordance with another embodiment of the present invention are installed. Hereinafter, the second hinge member in accordance with this embodiment will be described with reference to FIG. 9.

Some parts in this embodiment, which are substantially the same as those in the former embodiment shown in FIGS. 4 to 8, are denoted by the same reference numerals even though they are depicted in different drawings, and a detailed description thereof will thus be omitted because it is considered to be unnecessary.

In accordance with this embodiment of the present invention, a second hinge member 200 is installed at upper or lower portions of one side surface of the container 100.

Since the second hinge member 200 is installed at the upper or lower ends of the container 100, a possibility of generation of interference with a gasket installed at the container 100 may be reduced.

Further, two second hinge members 200 may be provided on the container 100.

Since the second hinge member 200 is installed in the depression part 14 of the cabinet 10, protrusion of the second hinge member 200 installed on the cabinet 10 toward the first storage area 2 may be prevented.

Figure 10:
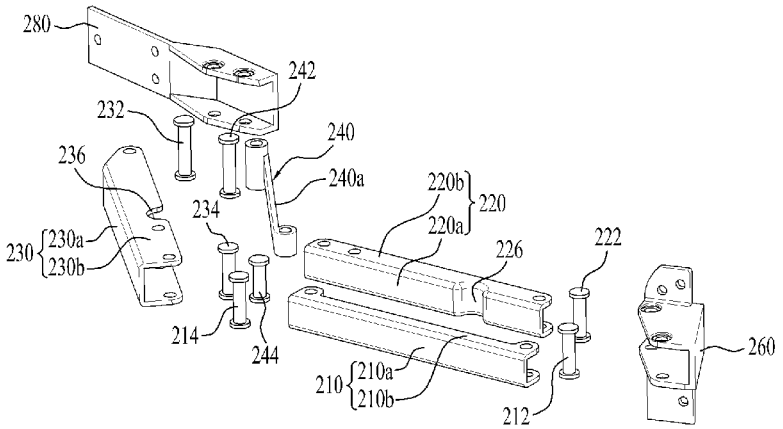
FIG. 10 is an exploded perspective view of the second hinge member of FIG. 9.
Figure 11:
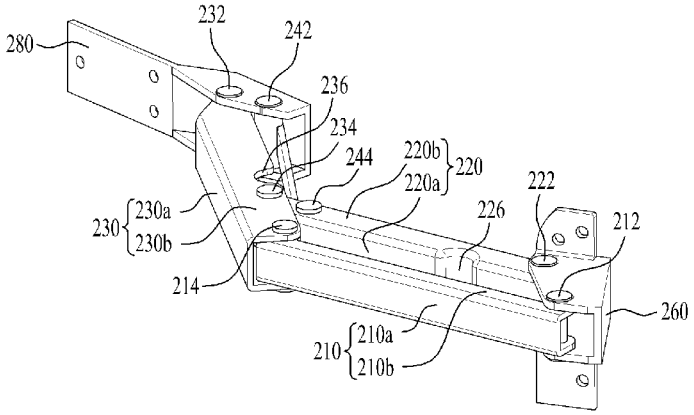
FIG. 11 is a perspective view illustrating the assembled second hinge member of FIG. 10.
Figure 12:
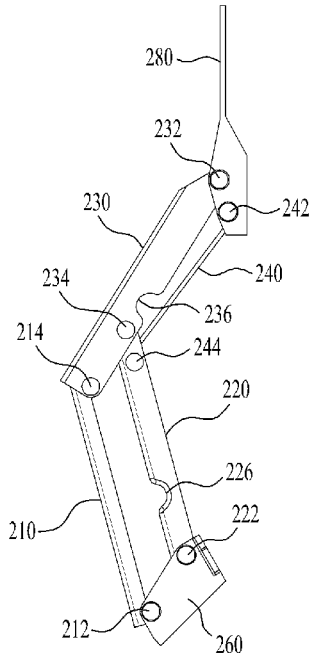
FIG. 12 is a plan view of FIG. 11.

FIG. 10 is an exploded perspective view of the second hinge member of FIG. 9, FIG. 11 is a perspective view illustrating the assembled second hinge member of FIG. 10, and FIG. 12 is a plan view of FIG. 11. Hereinafter, the second hinge member will be described in more detail with reference to FIGS. 10 to 12.

A first mount part 260 fixes a first link 210 so as to rotate the first link 210 about a rotary shaft 212 and fixes a second link 220 so as to rotate the second link 220 about a rotary shaft 222. Here, the first mount part 260 may be installed at one side of the container 100.

Further, a second mount part 280 may fix a third link 230 so as to rotate the third link 230 about a rotary shaft 232 and fix a fourth link 240 so as to rotate the fourth link 240 about a rotary shaft 242.

The first link 210 and the third link 230 may be connected by a rotary shaft 214 so as to be rotatable with respect to each other. The second link 220 and the fourth link 240 may be connected by a rotary shaft 234 so as to be rotatable with respect to each other. Further, the second link 220 and the fourth link 240 may be connected by a rotary shaft 244 so as to be rotatable with respect to each other.

The first link 210 may include a vertical surface **210*a* provided vertically and two extension surfaces 210*b* bent from both sides of the vertical surface 210*a* and extended. The extension surfaces 210*b* may be extended in the perpendicular direction from the vertical surface 210*a* at a designated curvature to the vertical surface 210*a*. That is, the first link 210 may generally have a L-shaped cross-section. Therefore, the first link 210 may secure sufficient strength to withstand vertical load applied when the container 100 and the cabinet 10 are connected. Further, the respective rotary shafts pass through the two extension surfaces 210*b* and thus, applied vertical load may be transmitted to the broad area of the first link 210. That is, not only the part of the first link 210 connected to the first mount part 260 but also the part of the first link 210** connected to another link may secure sufficient vertical strength.

The second link 220 may include a vertical surface **220*a* provided vertically and two extension surfaces 220*b* bent from both sides of the vertical surface 220*a* and extended. The extension surfaces 220*b* may be extended in the perpendicular direction from the vertical surface 220*a* at a designated curvature to the vertical surface 220*a*. That is, the second link 220 may generally have a L-shaped cross-section. Therefore, the second link 220 may secure sufficient strength to withstand vertical load applied when the container 100 and the cabinet 10 are connected. Further, the respective rotary shafts pass through the two extension surfaces 220***b* and thus, applied vertical load may be transmitted to the broad area of the second link 220. That is, not only the part of the second link 220 connected to the first mount part 260 but also the part of the second link 220 connected to another link may secure sufficient vertical strength.

The third link 230 may include a vertical surface 230*a* provided vertically and two extension surfaces 230*b* bent from both sides of the vertical surface 230*a* and extended. The extension surfaces 230*b* may be extended in the perpendicular direction from the vertical surface 230*a* at a designated curvature to the vertical surface 230*a*. That is, the third link 230 may generally have a L-shaped cross-section. Therefore, the third link 230 may secure sufficient strength to withstand vertical load applied when the container 100 and the cabinet 10 are connected. Further, the respective rotary shafts pass through the two extension surfaces 230*b* and thus, applied vertical load may be transmitted to the broad area of the third link 230. That is, not only the part of the third link 230 connected to the second mount part 280 but also the part of the third link 230 connected to another link may secure sufficient vertical strength.

The fourth link 240 may include a vertical surface 240*a* provided vertically and the vertical length of the vertical surface 240*a* of the fourth link 240 may be smaller than that of the vertical surface 230*a* of the third link 230. Further, the vertical length of the vertical surface 240*a* of the fourth link 240 may be smaller than that of the vertical surface 220*a* of the second link 220. This causes overlapping of the respective links 210, 220, 230, and 240 in the folded state of the second hinge member 200.

Figure 13:
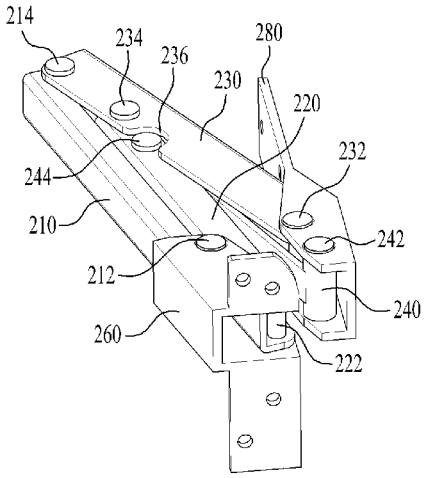
FIG. 13 is a perspective view illustrating the second hinge member in a folded state.
Figure 14:
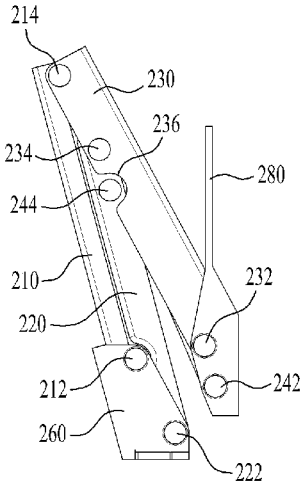
FIG. 14 is a plan view of FIG. 13.

FIG. 13 is a perspective view illustrating the second hinge member in a folded state and FIG. 14 is a plan view of FIG. 13. Hereinafter, the second hinge member will be described in more detail with reference to FIGS. 13 and 14.

In the folded state of the second hinge member 200, the respective links 210, 220, 230, and 240 may overlap and thus, a space of the first storage area 2 occupied by the second hinge member 200 may be reduced. Therefore, the storage space of the first storage area 2 may be effectively used.

Since the vertical length of the vertical surface 240*a* of the fourth link 240 may be smaller than those of the vertical surface 220*a* of the second link 220 and the vertical surface 230*a* of the third link 230, when the second hinge member 200 is folded, a part of the fourth link 240 may overlap the second link 220 and the third link 230.

The second link 220 includes a first escape groove 226 which the rotary shaft 212 installed on the first link 210 does not contact. Therefore, in the folded state of the second hinge member 200, interference between the first link 210 and the second link 220 may be prevented. The first escape groove 226 may have a greater diameter than the diameter of the rotary shaft 212 so as not to contact the rotary shaft 212.

The third link 230 includes a second escape groove 236 which the rotary shaft 244 installed on the fourth link 240 does not contact. Therefore, in the folded state of the second hinge member 200, interference between the third link 230 and the fourth link 240 may be prevented. The second escape groove 236 may have a greater diameter than the diameter of the rotary shaft 244 so as not to contact the rotary shaft 244.

In this embodiment of the present invention, the vertical surface 210*a* of the first link 210, the vertical surface 220*a* of the second link 220, the vertical surface 230*a* of the third link 230, and the vertical surface 240*a* of the fourth link 240 may be disposed so that the centers thereof are coplanar.

That is, the second hinge member 200 includes the four links 210, 220, 230, and 240 but the length of the second hinge member 200 in the vertical direction is smaller than the sum of the vertical lengths of the four links 210, 220, 230, and 240. The length of the second hinge member 200 in the vertical direction may be greater than only that of the vertical surface 210*a* of the first link 210. Therefore, the second hinge member 200 is not extended in the vertical direction and thus, increase in the length of the displacement of the second hinge member 200 to withstand vertical load at connection points of the respective links 210, 220, 230, and 240 may be prevented.

For example, when the respective links 210, 220, 230, and 240 are sequentially connected in the vertical direction, displacement due to force applied to connection regions between the respective links 210, 220, 230, and 240 is increased and thus, displacements of the container 100 and the cabinet 10 in the vertical direction are finally increased. In order to prevent such a problem, the length of the second hinge member 200 in the vertical direction is not greatly increased, displacement in the vertical direction is not greatly increased, as compared to the same load of the container 100.

As apparent from the above description, a refrigerator in accordance with one embodiment of the present invention has several effects, as follows.

First, only one door to open and close a main storage area and a subsidiary storage area is provided and thus, cool air loss may be reduced, as compared to the case in which two doors are provided, and a defrost heater is not required. Therefore, increase in power consumption may be prevented.

Second, a hinge member to rotate a container is installed on a cabinet and thus, a structure to install the hinge member on the door is not required and a sufficient thickness of the door for insulation may be secured.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A refrigerator comprising:

a cabinet defining a first storage area that is configured to store food;

a door that is connected to the cabinet by a first hinge member and that is configured to open and close at least a portion of the first storage area, the door being rotatable about a first rotary shaft of the first hinge member that is located at a front portion of the cabinet, the door having storage parts to store food on an inner surface of the door;

a gasket provided on the door;

a container defining a second storage area that is configured to store food, and that is received in the first storage area, the container being connected to an inner surface of the cabinet by a second hinge member located within the cabinet, the container being rotatable relative to the cabinet, and the second hinge member including:

a first link that is located on the container and that is rotatable relative to the container;

a second link that is located on the container and that is rotatable relative to the container;

a third link that is located on the cabinet and that is rotatable relative to the cabinet, the third link being connected to the first link by a second rotary shaft such that the third link is rotatable relative to the first link; and a fourth link that is located on the cabinet and that is rotatable relative to the cabinet, the fourth link being connected to the second link by a third rotary shaft such that the fourth link is rotatable relative to the second link, and a latch that is located on the door and that is configured to selectively latch the container with the door, wherein the latch is configured to latch the container with the door based on both the door, and the container being opened, and to release the container and the door based on the door being opened, and wherein each of the first link, the second link, and the third link includes a vertical surface that is configured to be oriented vertically, and two extension surfaces bent from both sides of the vertical surface and that are configured to extend.

2. The refrigerator according to claim 1, further comprising:

a first mount part that is located on the container and that connects the first link and the second link to the container in a rotatable manner; and a second mount part that is located on the cabinet and that connects the third link and the fourth link to the cabinet in a rotatable manner.

3. The refrigerator according to claim 2, wherein the first mount part is located on a side surface of the container.

4. The refrigerator according to claim 2, wherein the first mount part is located on at least one of upper and lower portions of a side surface of the container.

5. The refrigerator according to claim 2, wherein the second mount part is located in a depression part formed within the cabinet.

6. The refrigerator according to claim 1, wherein, based on the container being received in the first storage area and the door being oriented in a closed position, parts of the first link, the second link, the third link, and the fourth link overlap each other.

7. The refrigerator according to claim 1, wherein each of the second and third rotary shafts are configured to pass through the two extension surfaces.

8. The refrigerator according to claim 1, wherein the vertical surface of the first link, the vertical surface of the second link, and the vertical surface of the third link are coplanar.

9. The refrigerator according to claim 1, wherein the second link includes a first groove which the second rotary shaft at the first link does not contact.

10. The refrigerator according to claim 1, wherein the third link includes a second groove which the third rotary shaft at the fourth link does not contact.

11. The refrigerator according to claim 1, wherein:

the fourth link includes a vertical surface oriented vertically; and a length of the vertical surface of the fourth link is smaller than that of the vertical surface of the third link.

12. The refrigerator according to claim 1, wherein lengths of the vertical surfaces of the first link and the second link are smaller than that of the vertical surface of the third link.

13. The refrigerator according to claim 1, wherein, based on the container being rotated, the second and third rotary shafts are moved together with rotation of the container.

14. The refrigerator according to claim 1, wherein the second hinge member is located within the cabinet on an interior side wall of the cabinet that defines a side of the first storage space.

15. A refrigerator comprising:

a cabinet defining a first storage area that is configured to store food;

a door that is connected to the cabinet by a first hinge member and that is configured to open and close at least a portion of the first storage area, the door being rotatable about a first rotary shaft of the first hinge member that is located at a front portion of the cabinet, the door having storage parts to store food on an inner surface of the door;

a gasket provided on the door;

a container defining a second storage area that is configured to store food, and that is received in the first storage area, the container being connected to an inner surface of the cabinet by a second hinge member located within the cabinet, the container being rotatable relative to the cabinet, and the second hinge member including:

a first link that is located on the container and that is rotatable relative to the container;

a second link that is located on the container and that is rotatable relative to the container;

a third link that is located on the cabinet and that is rotatable relative to the cabinet, the third link being connected to the first link by a second rotary shaft such that the third link is rotatable relative to the first link; and a fourth link that is located on the cabinet and that is rotatable relative to the cabinet, the fourth link being connected to the second link by a third rotary shaft such that the fourth link is rotatable relative to the second link, a latch that is located on the door and that is configured to selectively latch the container with the door, and an operation unit that is located on the door and configured to control the latch to latch the container with the door and release the container and the door, wherein the latch is configured to latch the container with the door based on both the door and the container being opened, and to release the container and the door based on the door being opened, wherein the container is independent of the cabinet and the door, the door and the container are rotatably disposed on the cabinet independently of each other, and the gasket contacts a front surface of the cabinet based on the door being oriented in a closed position that closes the first storage area and covers the container.

16. The refrigerator according to claim 15, further comprising:

a fixing device that is located on the container and that is configured to selectively fix the container with the cabinet, the fixing device being configured to fix the container with the cabinet based on the door being opened alone and to release the container and the cabinet based on both the door and the container being opened together.

* * * * *